US010316259B2

(12) United States Patent
Dittrich et al.

(10) Patent No.: US 10,316,259 B2
(45) **Date of Patent: *Jun. 11, 2019**

(54) PROCESS FOR CONVERTING HYDROCARBONS INTO OLEFINS

(71) Applicants: Saudi Basic Industries Corporation, Riyadh (SA); SABIC Global Technologies, B.V., PX Bergen op Zoom (NL)

(72) Inventors: Christoph Dittrich, Geleen (NL); Joris Van Willigenburg, Geleen (NL); Raúl Velasco Pelaez, Geleen (NL); Egidius Jacoba Maria Schaerlaeckens, Geleen (NL); Vijayanand Rajagopalan, Bangalore (IN); Andrew Mark Ward, Wilton Centre (GB); Arno Johannes Maria Oprins, Geleen (NL); Ravichander Narayanaswamy, Bangalore (IN)

(73) Assignees: SAUDI BASIC INDUSTRIES CORPORATION, Riyadh (SA); SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/120,949

(22) PCT Filed: Dec. 23, 2014

(86) PCT No.: PCT/EP2014/079210

§ 371 (c)(1),
(2) Date: Aug. 23, 2016

(87) PCT Pub. No.: WO2015/128039

PCT Pub. Date: Sep. 3, 2015

(65) Prior Publication Data

US 2016/0369186 A1 Dec. 22, 2016

(30) Foreign Application Priority Data

Feb. 25, 2014 (EP) ..... 14156633

(51) Int. Cl.
*C10G 69/00* (2006.01)
*C10G 69/04* (2006.01)
*C10G 69/06* (2006.01)

(52) U.S. Cl.
CPC ..... *C10G 69/00* (2013.01); *C10G 69/04* (2013.01); *C10G 69/06* (2013.01); *C10G 2400/20* (2013.01); *C10G 2400/30* (2013.01)

(58) Field of Classification Search
None
See application file for complete search history.

(56) References Cited

U.S. PATENT DOCUMENTS 3,718,575 A * 2/1973 Watkins ..... C10G 65/10 208/103
3,842,138 A * 10/1974 Chahvekilian et al. .. C07C 4/04 585/501

(Continued)

FOREIGN PATENT DOCUMENTS

CN 102795958 11/2012
JP S60-4136 1/1985

(Continued)

OTHER PUBLICATIONS

International Search Report and Written Opinion of International Application No. PCT/EP2014/0792170; 12 pages; dated Mar. 15, 2015.

(Continued)

*Primary Examiner* — Tam M Nguyen
(74) *Attorney, Agent, or Firm* — Norton Rose Fulbright US LLP

(57) ABSTRACT

A process for converting hydrocarbon feedstock into olefins and BTX including feeding a hydrocarbon feedstock to a (Continued)

first hydrocracking unit, feeding effluent from the first hydrocracking unit to a first separation section to be separated, feeding a steam including propane to a dehydrogenation unit, and feeding effluent from the dehydrogenation unit to a second separation section.

19 Claims, 5 Drawing Sheets

(56) References Cited

U.S. PATENT DOCUMENTS

| | | | | |
|---|---|---|---|---|
| 4,137,147 | A * | 1/1979 | Franck | B01J 29/20 208/61 |
| 4,150,060 | A * | 4/1979 | Antos | B01J 23/6567 585/374 |
| 4,458,096 | A * | 7/1984 | Phillips | C07C 11/04 208/130 |
| 6,153,087 | A | 11/2000 | Bigeard et al. | |
| 6,270,654 | B1 | 8/2001 | Colyar et al. | |
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,840,674 | B2 | 12/2017 | Weiss et al. | |
| 2003/0221990 | A1 | 12/2003 | Yoon et al. | |
| 2008/0083261 | A1 | 4/2008 | Powers | |
| 2008/0093262 | A1 | 4/2008 | Gragnani et al. | |
| 2009/0050523 | A1 | 2/2009 | Halsey | |
| 2012/0125811 | A1 | 5/2012 | Bridges et al. | |
| 2012/0125812 | A1 | 5/2012 | Bridges et al. | |
| 2012/0125813 | A1 | 5/2012 | Bridges et al. | |
| 2014/0299515 | A1 | 10/2014 | Weiss et al. | |
| 2016/0122666 | A1 | 5/2016 | Weiss et al. | |

FOREIGN PATENT DOCUMENTS

| | | | |
|---|---|---|---|
| WO | 20060124175 | A2 | 11/2006 |
| WO | 2010111199 | A2 | 9/2010 |
| WO | 2013182534 | A1 | 6/2013 |
| WO | WO 2016/146326 | | 9/2016 |

OTHER PUBLICATIONS

Office Action issued in Japanese Patent Application No. 2016-570165, dated Mar. 27, 2018.

* cited by examiner

PROCESS FOR CONVERTING HYDROCARBONS INTO OLEFINS

CROSS-REFERENCE TO RELATED APPLICATIONS

This application is a national phase under 35 U.S.C. § 371 of International Application No. PCT/EP2014/079210, filed Dec. 23, 2014, which claims the benefits of priority to European Application No. 14156633.1, filed Feb. 25, 2014, the entire contents of each of which are hereby incorporated by reference in their entirety.

TECHNICAL FIELD AND BACKGROUND OF THE INVENTION

The present invention relates to a process for converting hydrocarbons, e.g. naphtha, into olefins and preferably also into BTX. More in detail, the present invention relates to an integrated process based on a combination of hydrocracking, thermal and dehydrogenation to convert naphtha into olefins and preferably also into BTX as well.

U.S. Pat. No. 4,137,147 relates to a process for manufacturing ethylene and propylene from a charge having a distillation point lower than about 360 DEG C. and containing at least normal and iso-paraffins having at least 4 carbon atoms per molecule, wherein: the charge is subjected to a hydrogenolysis reaction in a hydrogenolysis zone, in the presence of a catalyst, (b) the effluents from the hydrogenolysis reaction are fed to a separation zone from which are discharged (i) from the top, methane and possibly hydrogen, (ii) a fraction consisting essentially of hydrocarbons with 2 and 3 carbon atoms per molecule, and (iii) from the bottom, a fraction consisting essentially of hydrocarbons with at least 4 carbon atoms per molecule, (c) only the fraction consisting essentially of hydrocarbons with 2 and 3 carbon atoms per molecule is fed to a steam-cracking zone, in the presence of steam, to transform at least a portion of the hydrocarbons with 2 and 3 carbon atoms per molecule to monoolefinic hydrocarbons; the fraction consisting essentially of hydrocarbons with at least 4 carbon atoms per molecule, obtained from the bottom of the separation zone, is supplied to a second hydrogenolysis zone where it is treated in the presence of a catalyst, the effluent from the second hydrogenolysis zone is supplied to a separation zone to discharge, on the one hand, hydrocarbons with at least 4 carbon atoms per molecule which are recycled at least partly to the second hydrogenolysis zone, and, on the other hand, a fraction consisting essentially of a mixture of hydrogen, methane and saturated hydrocarbons with 2 and 3 carbon atoms per molecule; a hydrogen stream and a methane stream are separated from the mixture and there is fed to the steam-cracking zone the hydrocarbons of the mixture with 2 and 3 carbon atoms, together with the fraction consisting essentially of hydrocarbons with 2 and 3 carbon atoms per molecule as recovered from the separation zone following the first hydrogenolysis zone. At the outlet of the steam-cracking zone are thus obtained, in addition to a stream of methane and hydrogen and a stream of paraffinic hydrocarbons with 2 and 3 carbon atoms per molecule, olefins with 2 and 3 carbon atoms per molecule and products with at least 4 carbon atoms per molecule. According to this U.S. Pat. No. 4,137,147 all C4+ compounds are further processed in the second hydrogenolysis zone.

WO2010/111199 relates to a process for producing olefins comprising the steps of: (a) feeding a stream comprising butane to a dehydrogenation unit for converting butane to butenes and butadiene to produce a dehydrogenation unit product stream; (b) feeding the dehydrogenation unit product stream to a butadiene extraction unit to produce a butadiene product stream and a raffinate stream comprising butenes and residual butadiene; (c) feeding the raffinate stream to a selective hydrogenation unit for converting the residual butadiene to butenes to produce a selective hydrogenation unit product stream; (d) feeding the selective hydrogenation unit product stream to a deisobutenizer for separating isobutane and isobutene from the hydrogenation unit product stream to produce an isobutane/isobutene stream and a deisobutenizer product stream; (e) feeding the deisobutenizer unit product stream and a feed stream comprising ethylene to an olefin conversion unit capable of reacting butenes with ethylene to form propylene to form an olefin conversion unit product stream; and (f) recovering propylene from the olefin conversion unit product stream.

WO2006/124175 relates to a process for conversion of a gas oil, vacuum gas oil and atmospheric residue to produce olefins, benzene, toluene and xylene and ultra low sulfur diesel which process comprises: (a) reacting the hydrocarbon feedstock in a fluid catalytic cracking zone to produce C4-C6 olefins and light cycle oil (LCO), (b) reacting the C4-C6 olefins in an olefin cracking unit to produce ethylene and propylene, (c) reacting the light cycle oil in a hydrocracking zone containing a hydrocracking catalyst to produce a hydrocracking zone effluent comprising aromatic compounds and ultra low sulfur diesel, and (d) recovering ethylene, propylene, aromatic compounds and ultra low sulfur diesel.

Conventionally, crude oil is processed, via distillation, into a number of cuts such as naphtha, gas oils and residua. Each of these cuts has a number of potential uses such as for producing transportation fuels such as gasoline, diesel and kerosene or as feeds to some petrochemicals and other processing units.

Light crude oil cuts such as naphtha and some gas oils can be used for producing light olefins and single ring aromatic compounds via processes such as ethane dehydrogenation in which the hydrocarbon feed stream is evaporated and diluted with steam and then exposed to a very high temperature (750° C. to 900° C.) in short residence time (<1 second) furnace (reactor) tubes. In such a process the hydrocarbon molecules in the feed are transformed into (on average) shorter molecules and molecules with lower hydrogen to carbon ratios (such as olefins) when compared to the feed molecules. This process also generates hydrogen as a useful by-product and significant quantities of lower value co-products such as methane and C9+ Aromatics and condensed aromatic species (containing two or more aromatic rings which share edges).

Typically, the heavier (or higher boiling point) aromatic species, such as residua are further processed in a crude oil refinery to maximize the yields of lighter (distillable) products from the crude oil. This processing can be carried out by processes such as hydro-cracking (whereby the hydrocracker feed is exposed to a suitable catalyst under conditions which result in some fraction of the feed molecules being cracked into shorter hydrocarbon molecules with the simultaneous addition of hydrogen). Heavy refinery stream hydrocracking is typically carried out at high pressures and temperatures and thus has a high capital cost.

An aspect of such a combination of crude oil distillation and steam cracking of the lighter distillation cuts is the capital and other costs associated with the fractional distillation of crude oil. Heavier crude oil cuts (i.e. those boiling beyond ~350° C.) are relatively rich in substituted aromatic species and especially substituted condensed aromatic species (containing two or more aromatic rings which share edges) and under steam cracking conditions these materials yield substantial quantities of heavy by-products such as C9+ aromatics and condensed aromatics. Hence, a consequence of the conventional combination of crude oil distillation and steam cracking is that a substantial fraction of the crude oil, for example 50% by weight, is not processed via the steam cracker as the cracking yield of valuable products from heavier cuts is not considered to be sufficiently high.

Another aspect of the technology discussed above is that even if only light crude oil cuts (such as naphtha) are processed via steam cracking a significant fraction of the feed stream is converted into low value heavy by-products such as C9+ aromatics and condensed aromatics. With typical naphthas and gas oils these heavy by-products might constitute 2 to 25% of the total product yield (Table VI, Page 295, Pyrolysis: Theory and Industrial Practice by Lyle F. Albright et al, Academic Press, 1983). Whilst this represents a significant financial downgrade of expensive naphtha and/or gas oil in lower value material on the scale of a conventional steam cracker the yield of these heavy by-products does not typically justify the capital investment required to up-grade these materials (e.g. by hydrocracking) into streams that might produce significant quantities of higher value chemicals. This is partly because hydrocracking plants have high capital costs and, as with most petrochemicals processes, the capital cost of these units typically scales with throughput raised to the power of 0.6 or 0.7. Consequently, the capital costs of a small scale hydrocracking unit are normally considered to be too high to justify such an investment to process steam cracker heavy by-products.

Another aspect of the conventional hydrocracking of heavy refinery streams such as residua is that this is typically carried out under compromise conditions that are chosen to achieve the desired overall conversion. As the feed streams contain a mixture of species with a range of easiness of cracking this result in some fraction of the distillable products formed by hydrocracking of relatively easily hydrocracked species being further converted under the conditions necessary to hydrocrack species more difficult to hydrocrack. This increases the hydrogen consumption and heat management difficulties associated with the process. And also the yield of light molecules such as methane increases at the expense of more valuable species.

A result of such a combination of crude oil distillation and steam cracking of the lighter distillation cuts is that steam cracking furnace tubes are typically unsuitable for the processing of cuts which contain significant quantities of material with a boiling point greater than ~350° C. as it is difficult to ensure complete evaporation of these cuts prior to exposing the mixed hydrocarbon and steam stream to the high temperatures required to promote thermal cracking. If droplets of liquid hydrocarbon are present in the hot sections of cracking tubes coke is rapidly deposited on the tube surface which reduces heat transfer and increases pressure drop and ultimately curtails the operation of the cracking tube necessitating a shut-down of the tube to allow for decoking. Due to this difficulty a significant proportion of the original crude oil cannot be processed into light olefins and aromatic species via a steam cracker.

US 2012/0125813, US 2012/0125812 and US 2012/0125811 relate to a process for cracking a heavy hydrocarbon feed comprising a vaporization step, a distillation step, a coking step, a hydroprocessing step, and a steam cracking step. For example, US 2012/0125813 relates to a process for steam cracking a heavy hydrocarbon feed to produce ethylene, propylene, C4 olefins, pyrolysis gasoline, and other products, wherein steam cracking of hydrocarbons, i.e. a mixture of a hydrocarbon feed such as ethane, propane, naphtha, gas oil, or other hydrocarbon fractions, is a non-catalytic petrochemical process that is widely used to produce olefins such as ethylene, propylene, butenes, butadiene, and aromatics such as benzene, toluene, and xylenes.

US 2009/0050523 relates to the formation of olefins by thermal cracking in a pyrolysis furnace of liquid whole crude oil and/or condensate derived from natural gas in a manner that is integrated with a hydrocracking operation.

US 2008/0093261 relates to the formation of olefins by hydrocarbon thermal cracking in a pyrolysis furnace of liquid whole crude oil and/or condensate derived from natural gas in a manner that is integrated with a crude oil refinery.

Steam cracking of naphtha results in a high yield of methane and a relatively low yield in propylene (propylene/ethylene ratio of about 0.5) as well as a relatively low yield of BTX, BTX is also accompanied by co-boilers of the valuable components benzene, toluene and xylenes which do not allow recovering those on-spec by simple distillation but by more elaborate separation techniques such as solvent extraction.

FCC technology applied to naphtha feed does result in a much higher relative propylene yield (propylene/ethylene ratio of 1-1.5) but still has relatively large losses to methane and cycle oils in addition to the desired aromatics (BTX).

BRIEF SUMMARY OF THE INVENTION

As used herein, the term "C# hydrocarbons" or "C#", wherein "#" is a positive integer, is meant to describe all hydrocarbons having # carbon atoms. Moreover, the term "C#+ hydrocarbons" or "C#+" is meant to describe all hydrocarbon molecules having # or more carbon atoms. Accordingly, the term "C5+ hydrocarbons" or "C5+" is meant to describe a mixture of hydrocarbons having 5 or more carbon atoms. The term "C5+ alkanes" accordingly relates to alkanes having 5 or more carbon atoms. Accordingly, the term "C# minus hydrocarbons" or "C# minus" is meant to describe a mixture of hydrocarbons having # or less carbon atoms and including hydrogen. For example, the term "C2−" or "C2 minus" relates to a mixture of ethane, ethylene, acetylene, methane and hydrogen. Finally, the term "C4mix" is meant to describe a mixture of butanes, butenes and butadiene, i.e. n-butane, i-butane, 1-butene, cis- and trans-2-butene, i-butene and butadiene. Fore example, the term C1-C3 includes a mixture of C1, C2 and C3.

The term "olefin" is used herein having its well-established meaning. Accordingly, olefin relates to an unsaturated hydrocarbon compound containing at least one carbon-carbon double bond. Preferably, the term "olefins" relates to a mixture comprising two or more of ethylene, propylene, butadiene, butylene-1, isobutylene, isoprene and cyclopentadiene. Pure or mixed olefins with the same carbon number are named with the term "C#=", e.g. "C2=" denotes ethylene.

The term "LPG" as used herein refers to the well-established acronym for the term "liquefied petroleum gas". LPG generally consists of a blend of C3-C4 hydrocarbons i.e. a mixture of C3 and C4 hydrocarbons.

The one of the petrochemical products produced in the process of the present invention is BTX. The term "BTX" as used herein relates to a mixture of benzene, toluene and xylenes. Preferably, the product produced in the process of the present invention comprises further useful aromatic hydrocarbons such as ethyl benzene. Accordingly, the present invention preferably provides a process for producing a mixture of benzene, toluene xylenes and ethyl benzene ("BTXE"). The product as produced may be a physical mixture of the different aromatic hydrocarbons or may be directly subjected to further separation, e.g. by distillation, to provide different purified product streams. Such purified product stream may include a benzene product stream, a toluene product stream, a xylene product stream and/or an ethyl benzene product stream.

An object of the present invention is to provide a method for converting naphtha into olefins and preferably also into BTX as well.

Another object of the present invention is to provide a method having high carbon efficiency by a much lower methane production and a minimum of heavy by-products.

Another object of the present invention is to provide a method for converting naphtha into useful hydrocarbons incorporating an integration of a hydrogen producing step and a hydrogen consuming process step which allows for better hydrogen economics and balancing.

The present invention thus relates to a process for converting a hydrocarbon feedstock into olefins and BTX, the converting process comprising the following steps of:

feeding a hydrocarbon feedstock to a first hydrocracking unit;

feeding the effluent from said first hydrocracking unit to a first separation section;

separating said effluent in said first separation section into one or more streams chosen from the group of a stream comprising hydrogen, a stream comprising methane, a stream comprising ethane, a stream comprising propane, a stream comprising butanes, a stream comprising C1-minus, a stream comprising C2-minus, a stream comprising C3-minus, a stream comprising C4-minus, a stream comprising C1-C2, a stream comprising C1-C3, a stream comprising C1-C4, a stream comprising C2-C3, a stream comprising C2-C4, a stream comprising C3-C4 and a stream comprising C5+;

feeding a stream comprising propane to at least one dehydrogenation unit chosen from the group of combined propane/butanes dehydrogenation unit (PDH-BDH) and a propane dehydrogenation unit (PDH);

feeding at least one stream chosen from the group of a stream comprising C2-minus, a stream comprising ethane and a stream comprising C1-C2 to a gas steam cracking unit and/or to a second separation unit;

feeding at least one of the effluents from said dehydrogenation unit(s) and said gas steam cracking unit to a said second separation section.

The present invention allows for much higher carbon efficiency (i.e. much lower methane production and no heavy by-products). In addition it is possible to have direct production (i.e. the co-boilers of benzene are converted in the process rather than that they need to be removed by means of several physical separation steps). In addition the present method allows for a much better control/larger control range over the propylene/ethylene ratio by adjusting the operating temperature in the hydrocracking unit, i.e. a wider range of propylene/ethylene ratio can be covered.

It is preferred to feed a stream comprising butanes to at least one dehydrogenation unit chosen from the group of combined propane/butanes dehydrogenation unit (PDH-BDH) and butanes dehydrogenation unit (BDH).

According to the present method at least one stream chosen from the group of a stream comprising C2-minus and a stream comprising ethane is fed to a gas steam cracking unit and/or the second separation unit. Steam cracking is the most common ethane dehydrogenation process. In the present description the term "gas steam cracking unit" and "ethane dehydrogenation unit" is used for the same process units. The present method further preferably comprises feeding a stream comprising C1-C2 to a gas steam cracking unit and/or the second separation unit.

The present process further preferably comprises feeding the stream comprising ethane to the a gas steam cracking unit, wherein the effluent from the gas steam cracking unit is preferably fed to the second separation unit.

According to the present invention the in the at least one dehydrogenation unit carried out dehydrogenating process is a catalytic process and the steam cracking process is a thermal cracking process. This means that the effluent from the first separation section is further processed in the combination of a catalytic process, i.e. a dehydrogenation process, and a thermal process, i.e. a steam cracking process.

According to a preferred embodiment the present process further comprises separating any effluent from the ethane dehydrogenation unit, the first separation section, the butanes dehydrogenation unit, the combined propane/butanes dehydrogenation unit (PDH-BDH) and the propane dehydrogenation unit in the second separation section into one or more streams chosen form the group of a stream comprising hydrogen, a stream comprising methane, a stream comprising C3, a stream comprising C2=, a stream comprising C3=, a stream comprising C4mix, a stream comprising C5+, a stream comprising C2 and a stream comprising C1-minus.

The present process further preferably comprises feeding the stream comprising C2 coming from the second separation section to the gas steam cracking unit.

The present process further preferably comprises feeding the stream C5+ to the first hydrocracking unit and/or the second hydrocracking unit.

The present process further preferably comprises feeding the stream comprising C1-minus to the first separation section.

The present process further preferably comprises feeding the stream comprising C3 coming from the second separation unit to at least one dehydrogenation unit chosen from the group of combined propane/butanes dehydrogenation unit (PDH-BDH) and a propane dehydrogenation unit (PDH).

The present process preferably comprises feeding the stream comprising C5+ to a second hydrocracking unit. An extra advantage is the possibility to integrate the re-heating of the C5+ feed to the second hydrocracking unit coming from the first hydrocracking unit with the hot effluent.

The present second hydrocracking unit can be identified here as a "gasoline hydrocracking unit" or "GHC reactor". As used herein, the term "gasoline hydrocracking unit" or "GHC" refers to an unit for performing a hydrocracking process suitable for converting a complex hydrocarbon feed that is relatively rich in aromatic hydrocarbon compounds—such as refinery unit-derived light-distillate including, but not limited to, reformer gasoline, FCC gasoline and pyrolysis gasoline (pygas)—to LPG and BTX, wherein the process is optimized to keep one aromatic ring intact of the aromatics comprised in the GHC feed stream, but to remove most of the side-chains from the aromatic ring. Accordingly, the main product produced by gasoline hydrocracking is BTX and the process can be optimized to provide a BTX mixture which can simply be separated into chemicals-grade benzene, toluene and mixed xylenes. Preferably, the hydrocarbon feed that is subject to gasoline hydrocracking comprises refinery unit-derived light-distillate. More preferably, the hydrocarbon feed that is subjected to gasoline hydrocracking preferably does not comprise more than 1 wt.-% of hydrocarbons having more than one aromatic ring. Preferably, the gasoline hydrocracking conditions include a temperature of 300-580° C., more preferably of 450-580° C. and even more preferably of 470-550° C. Lower temperatures must be avoided since hydrogenation of the aromatic ring becomes favourable. However, in case the catalyst comprises a further element that reduces the hydrogenation activity of the catalyst, such as tin, lead or bismuth, lower temperatures may be selected for gasoline hydrocracking; see e.g. WO 02/44306 A1 and WO 2007/055488. In case the reaction temperature is too high, the yield of LPG's (especially propane and butanes) declines and the yield of methane rises. As the catalyst activity may decline over the lifetime of the catalyst, it is advantageous to increase the reactor temperature gradually over the life time of the catalyst to maintain the hydrocracking reaction rate. This means that the optimum temperature at the start of an operating cycle preferably is at the lower end of the hydrocracking temperature range. The optimum reactor temperature will rise as the catalyst deactivates so that at the end of a cycle (shortly before the catalyst is replaced or regenerated) the temperature preferably is selected at the higher end of the hydrocracking temperature range.

Preferably, the gasoline hydrocracking of a hydrocarbon feed stream is performed at a pressure of 0.3-5 MPa gauge, more preferably at a pressure of 0.6-3 MPa gauge, particularly preferably at a pressure of 1-2 MPa gauge and most preferably at a pressure of 1.2-1.6 MPa gauge. By increasing reactor pressure, conversion of C5+ non-aromatics can be increased, but this also increases the yield of methane and the hydrogenation of aromatic rings to cyclohexane species which can be cracked to LPG species. This results in a reduction in aromatic yield as the pressure is increased and, as some cyclohexane and its isomer methylcyclopentane, are not fully hydrocracked, there is an optimum in the purity of the resultant benzene at a pressure of 1.2-1.6 MPa.

Preferably, gasoline hydrocracking of a hydrocarbon feed stream is performed at a Weight Hourly Space Velocity (WHSV) of 0.1-20 h−1, more preferably at a Weight Hourly Space Velocity of 0.2-10 h−1 and most preferably at a Weight Hourly Space Velocity of 0.4-5 h−1. If the space velocity is too high, not all BTX co-boiling paraffin components are hydrocracked, so it will not be possible to achieve chemical grade benzene, toluene and mixed xylenes by simple distillation of the reactor product. At too low space velocity the yield of methane rises at the expense of propane and butane. By selecting the optimal Weight Hourly Space Velocity, it was surprisingly found that sufficiently complete reaction of the benzene co-boilers is achieved to produce on spec benzene.

Accordingly, preferred gasoline hydrocracking conditions thus include a temperature of 450-580° C., a pressure of 0.3-5 MPa gauge and a Weight Hourly Space Velocity of 0.1-20 h−1. More preferred gasoline hydrocracking conditions include a temperature of 470-550° C., a pressure of 0.6-3 MPa gauge and a Weight Hourly Space Velocity of 0.2-10 h−1. Particularly preferred gasoline hydrocracking conditions include a temperature of 470-550° C., a pressure of 1-2 MPa gauge and a Weight Hourly Space Velocity of 0.4-5 h−1.

The first hydrocracking unit can be identified here as a "feed hydrocracking unit" or "FHC reactor". As used herein, the term "feed hydrocracking unit" or "FHC" refers to a refinery unit for performing a hydrocracking process suitable for converting a complex hydrocarbon feed that is relatively rich in naphthenic and paraffinic hydrocarbon compounds—such as straight run cuts including, but not limited to, naphtha—to LPG and alkanes. Preferably, the hydrocarbon feed that is subject to feed hydrocracking comprises naphtha. Accordingly, the main product produced by feed hydrocracking is LPG that is to be converted into olefins (i.e. to be used as a feed for the conversion of alkanes to olefins). The FHC process may be optimized to keep one aromatic ring intact of the aromatics comprised in the FHC feed stream, but to remove most of the side-chains from the aromatic ring. In such a case, the process conditions to be employed for FHC are comparable to the process conditions to be used in the GHC process as described herein above. Alternatively, the FHC process can be optimized to open the aromatic ring of the aromatic hydrocarbons comprised in the FHC feed stream. This can be achieved by modifying the GHC process as described herein by increasing the hydrogenation activity of the catalyst, optionally in combination with selecting a lower process temperature, optionally in combination with a reduced space velocity. In such a case, preferred feed hydrocracking conditions thus include a temperature of 300-550° C., a pressure of 300-5000 kPa gauge and a Weight Hourly Space Velocity of 0.1-20 h−1. More preferred feed hydrocracking conditions include a temperature of 300-450° C., a pressure of 300-5000 kPa gauge and a Weight Hourly Space Velocity of 0.1-10 h−1. Even more preferred FHC conditions optimized to the ring-opening of aromatic hydrocarbons include a temperature of 300-400° C., a pressure of 600-3000 kPa gauge and a Weight Hourly Space Velocity of 0.2-5 h−1.

The present process further comprises separating the effluent from the second hydrocracking unit in a stream comprising C4−, a stream comprising unconverted C5+, and a stream comprising BTX, and preferably feeding the stream comprising C4− to the first separation section.

The present process further comprises combining the stream comprising unconverted C5+ with the naphtha and feeding the combined stream thus obtained to the first hydrocracking unit.

According to another embodiment the present process further comprises pre-treating the naphtha feed by separating the naphtha feed into a stream having a high aromatics content and a stream having a low aromatics content, and feeding the stream having a low aromatics content into the first hydrocracking unit, further comprising feeding the stream having a high aromatics content to the second hydrocracking unit.

For better hydrogen economics and balancing it is preferred to feed the stream comprising hydrogen from the first and/or second separation section to the first and/or second hydrocracking unit.

A very common process for the conversion of alkanes to olefins involves "steam cracking" As used herein, the term "steam cracking" relates to a petrochemical process in which saturated hydrocarbons are broken down into smaller, often unsaturated, hydrocarbons such as ethylene and propylene. In steam cracking gaseous hydrocarbon feeds like ethane, propane and butanes, or mixtures thereof, (gas cracking) or liquid hydrocarbon feeds like naphtha or gasoil (liquid cracking) is diluted with steam and briefly heated in a furnace without the presence of oxygen. Typically, the reaction temperature is very high, at around 850° C., but the reaction is only allowed to take place very briefly, usually with residence times of 50-500 milliseconds. Preferably, the hydrocarbon compounds ethane, propane and butanes are separately cracked in accordingly specialized furnaces to ensure cracking at optimal conditions. After the cracking temperature has been reached, the gas is quickly quenched to stop the reaction in a transfer line heat exchanger or inside a quenching header using quench oil. Steam cracking results in the slow deposition of coke, a form of carbon, on the reactor walls. Decoking requires the furnace to be isolated from the process and then a flow of steam or a steam/air mixture is passed through the furnace coils. This converts the hard solid carbon layer to carbon monoxide and carbon dioxide. Once this reaction is complete, the furnace is returned to service. The products produced by steam cracking depend on the composition of the feed, the hydrocarbon to steam ratio and on the cracking temperature and furnace residence time. Light hydrocarbon feeds such as ethane, propane, butanes or light naphtha give product streams rich in the lighter polymer grade olefins, including ethylene, propylene, and butadiene. Heavier hydrocarbon (full range and heavy naphtha and gas oil fractions) also give products rich in aromatic hydrocarbons.

To separate the different hydrocarbon compounds produced by steam cracking the cracked gas is subjected to fractionation unit. Such fractionation units are well known in the art and may comprise a so-called gasoline fractionator where the heavy-distillate ("carbon black oil") and the middle-distillate ("cracked distillate") are separated from the light-distillate and the gases. In the subsequent quench tower, most of the light-distillate produced by steam cracking ("pyrolysis gasoline" or "pygas") may be separated from the gases by condensing the light-distillate. Subsequently, the gases may be subjected to multiple compression stages wherein the remainder of the light distillate may be separated from the gases between the compression stages. Also acid gases (CO2 and H2S) may be removed between compression stages. In a following step, the gases produced by pyrolysis may be partially condensed over stages of a cascade refrigeration system to about where only the hydrogen remains in the gaseous phase. The different hydrocarbon compounds may subsequently be separated by simple distillation, wherein the ethylene, propylene and C4 olefins are the most important high-value chemicals produced by steam cracking. The methane produced by steam cracking is generally used as fuel gas, the hydrogen may be separated and recycled to processes that consume hydrogen, such as hydrocracking processes. The acetylene produced by steam cracking preferably is selectively hydrogenated to ethylene. The alkanes comprised in the cracked gas may be recycled to the process for converting alkanes to olefins.

The term "propane dehydrogenation unit" as used herein relates to a petrochemical process unit wherein a propane feedstream is converted into a product comprising propylene and hydrogen. Accordingly, the term "butane dehydrogenation unit" relates to a process unit for converting a butane feedstream into C4 olefins. Together, processes for the dehydrogenation of lower alkanes such as propane and butanes are described as lower alkane dehydrogenation process. Processes for the dehydrogenation of lower alkanes are well-known in the art and include oxidative hydrogenation processes and non-oxidative dehydrogenation processes. In an oxidative dehydrogenation process, the process heat is provided by partial oxidation of the lower alkane(s) in the feed. In a non-oxidative dehydrogenation process, which is preferred in the context of the present invention, the process heat for the endothermic dehydrogenation reaction is provided by external heat sources such as hot flue gases obtained by burning of fuel gas or steam. For instance, the UOP Oleflex process allows for the dehydrogenation of propane to form propylene and of (iso)butane to form (iso)butylene (or mixtures thereof) in the presence of a catalyst containing platinum supported on alumina in a moving bed reactor; see e.g. U.S. Pat. No. 4,827,072. The Uhde STAR process allows for the dehydrogenation of propane to form propylene or of butane to form butylene in the presence of a promoted platinum catalyst supported on a zinc-alumina spinel; see e.g. U.S. Pat. No. 4,926,005. The STAR process has been recently improved by applying the principle of oxydehydrogenation. In a secondary adiabatic zone in the reactor part of the hydrogen from the intermediate product is selectively converted with added oxygen to form water. This shifts the thermodynamic equilibrium to higher conversion and achieve higher yield. Also the external heat required for the endothermic dehydrogenation reaction is partly supplied by the exothermic hydrogen conversion. The Lummus Catofin process employs a number of fixed bed reactors operating on a cyclical basis. The catalyst is activated alumina impregnated with 18-20 wt-% chromium; see e.g. EP 0 192 059 A1 and GB 2 162 082 A. The Catofin process is reported to be robust and capable of handling impurities which would poison a platinum catalyst. The products produced by a butane dehydrogenation process depends on the nature of the butane feed and the butane dehydrogenation process used. Also the Catofin process allows for the dehydrogenation of butane to form butylene; see e.g. U.S. Pat. No. 7,622,623.

BRIEF DESCRIPTION OF THE DRAWINGS

The invention will be described in further detail below and in conjunction with the attached drawings in which the same of similar elements are referred to by the same number.

DETAILED DESCRIPTION OF THE INVENTION

Figure 1:
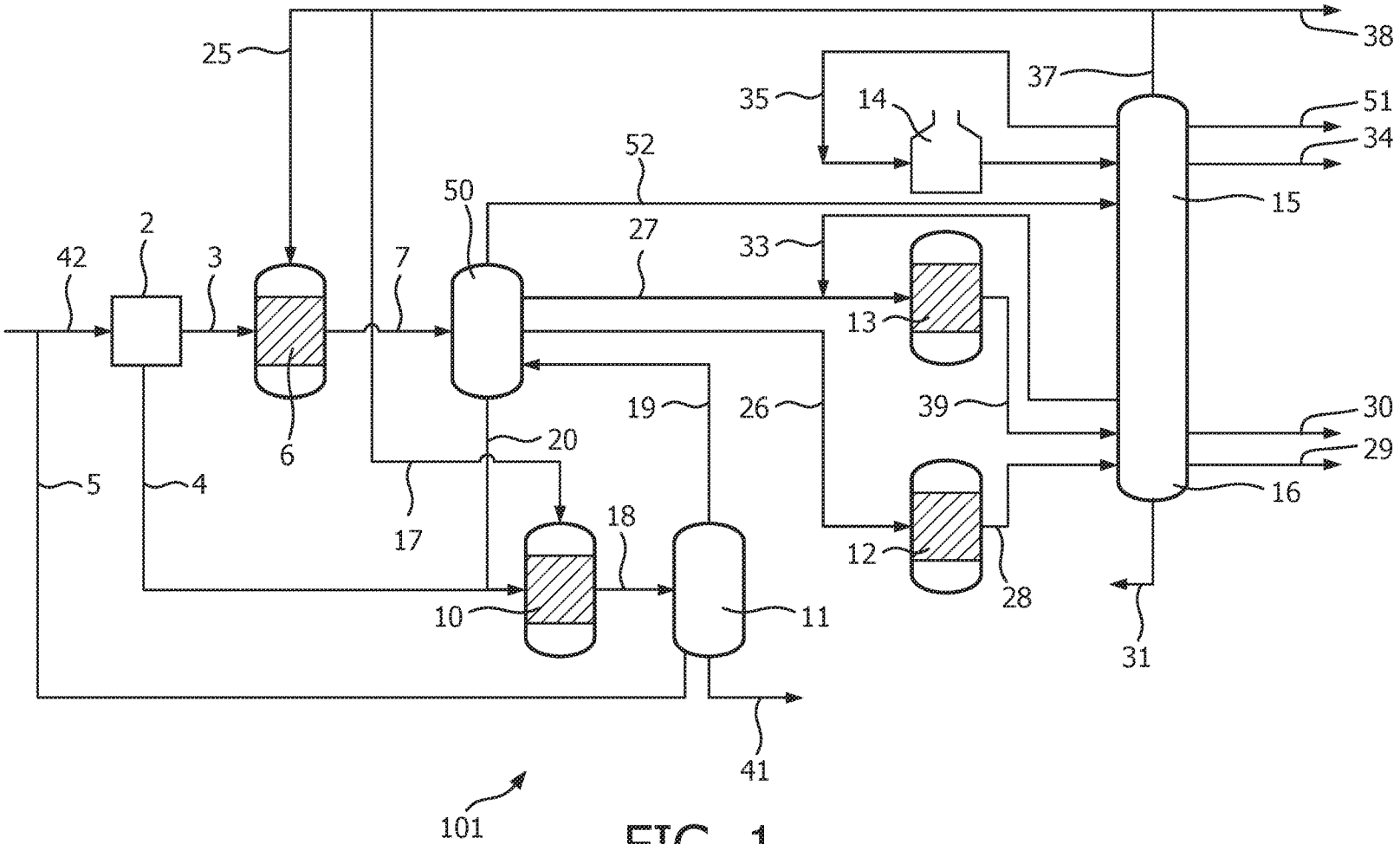
FIG. 1 is a schematic illustration of the embodiment of the process of the invention.

In general terms, naphtha or naphtha range hydrocarbon material is fed together with hydrogen to a first hydrocracking unit, a so called feed hydrocracking unit "FHC reactor", (possibly including desulphurization if necessary and possibly consisting of multiple reactor beds or reactors). Here the feed is converted into a mixed stream of hydrogen, methane, LPG, including C2 as a component, and C5+ (mostly containing BTX). The C5+ fraction can be separated and further processed in a pygas upgrading section or by means of a second hydrocracking unit, a so called gasoline hydrocracking unit "GHC reactor" as indicated in the Figures. This results in production of BTX virtually free of non-aromatic co-boilers, and of LPG being fed back to the first separation block. Any non-BTX material remaining in a pygas unit can be recycled to the FHC reactor inlet.

The FHC reactor effluent is further separated into separate streams containing mostly hydrogen, methane, ethane, propane and butane (all being the result of certain (individual) separation efficiency). The hydrogen is recycled to feed the first and second hydrocracking units and part of it is purged to prevent the build-up of methane and impurities. The methane stream can be exported or used as fuel for the different furnaces in the flowchart. The ethane is dehydrogenated to produce ethylene and unconverted ethane is separated in a second separation block to be recycled to the ethane dehydrogenation unit. The propane and butane streams are dehydrogenated in the propane dehydrogenation unit ("PDH") and the butane dehydrogenation unit ("BDH"), respectively (which can also be a combined PDH/BDH unit). The resulting effluents are also separated in the second separation block (possibly each unit having a stand-alone separation section, possibly having some degree of heat integration/integration of cooling systems and utilities etc.), or possibly having a fully combined effluent separation train similar to a steam cracker separation section. In principle the first and second separation block can also be (heat) integrated and/or (partially) combined. According to a preferred embodiment the concentrated olefinic product streams from the ethane dehydrogenation unit ("SC, steam cracking unit"), PDH and BDH units are kept separate from the upstream FHC separation section involving only paraffinic components.

Any heavier material other than mixed C4, propylene, ethylene, methane or hydrogen is preferably recycled to the feed of the first hydrocracking unit. The mixed C4 stream can be further processed, including the conversion with methanol into MTBE and separation from the remaining C4 olefins from the C4 paraffins. If a C4 paraffin separation is included the resulting butanes rich mixtures may be recycled to the dehydrogenation reactor for C4. Both the first and second separation section will have for example (if using cryogenic separation) a deethanizer and a demethanizer/cold box. Alternative separation technologies can be applied involving for example absorption (absorption processes for hydrocarbon separation), adsorption (PSA, pressure swing adsorption) and/or expander technology as usually found in gas separation plants. Steam cracker technology is preferably applying cryogenic separations.

In the integrated process 101 according to FIG. 1 the separation of the PDH/BDH effluent can here be limited to having a C2− top flow (i.e. no further/cooler separation than needed for the deethanizer) and the further separation of this fraction can be further done in the cold-section of the ethane cracker separation section. Any C3+ material obtained there (e.g. in the bottom of the deethanizer) can be sent to the PDH/BDH dehydrogenation section. In other words the C2 separation is located at the C2 processing line/steam cracker (used as ethane dehydrogenation unit here) and the C3/C4 separations are located in the PDH/BDH C3/C4 train. This way the number of demethanizers/cold boxes (as an example for a cryogenic separation concept) needed is reduced by 1. Other separations need for example less cooling or less difficult separation (usually possible with only a propylene cooling circuit in a cryogenic separation for example).

FIG. 1 provides an integrated process 101, based on a combination of hydrocracking, ethane dehydrogenation, steam cracking here, and propane/butanes dehydrogenation to convert naphtha into olefins and BTX. Feed 42, e.g. naphtha, is sent to a separation unit 2 producing a stream 4 having a high aromatic content and a stream 3 having a low aromatic content. Stream 4 is sent to hydrocracking unit 10 and its effluent 18 is separated in separation unit 11 into stream 19, mainly comprising C4− and stream 41 mainly comprising BTX. Non-converted C5+ is recycled, via line 5, to the inlet of hydrocracking unit 6, or in case stream 5 still comprises BTX, to the inlet of separation unit 2. The application of a separation unit 2 is optional which means that feedstock 42 can be sent directly into hydrocracking unit 6. Effluent 7 is sent to separation unit 50. Separation unit 50 provides stream 52, mainly comprising C2−, stream 27, mainly comprising C3, stream 26, mainly comprising C4 and a stream 20, mainly comprising C5+. Stream 20 is sent to hydrocracking unit 10 from which its effluent 18 is sent to a separation unit 11 and separated into stream 19, mainly comprising C4−, and a stream 41, mainly comprising BTX. Stream 19 is recycled to separation unit 50. Stream 27 coming from separation unit 50 is sent to a propane dehydrogenation unit 13 from which its effluent 39 is sent to a separation unit 15, 16. Stream 26 coming from separation unit 50 is sent to a butane dehydrogenation unit 12 from which its effluent 28 is sent to separation unit 15, 16 as well. Separation unit 15, 16 provides stream 30, mainly comprising C3=, stream 29, mainly comprising C4 mix and a stream 31, mainly comprising C5+. Recycle stream 33, mainly comprising C3, coming from separation unit 15, 16 is recycled to the inlet of unit 13. Stream 52 coming from separation unit 50 is sent to separation unit 15 and separated into, stream 37, mainly comprising hydrogen, stream 51, mainly comprising C1, and stream 34, mainly comprising C2=. Recycle stream 35, mainly comprising C2, coming from separation unit 15, 16 is recycled to the inlet of ethane dehydrogenation unit 14 from which its effluent is separated in separation unit 15, 16. Hydrogen containing stream 37 is sent to hydrocracking unit 6, via line 25, and to hydrocracking unit 10, via line 17, respectively. Although not shown here, hydrogen containing stream 37 may be purified, in addition to pressure increase. Stream 31 coming from separation unit 15, 16 as well as non-converted C5+ coming from separation unit 11 can be sent to the inlet of hydrocracking unit 6. The surplus of hydrogen is sent, via line 38, to other chemical processes.

Figure 2:
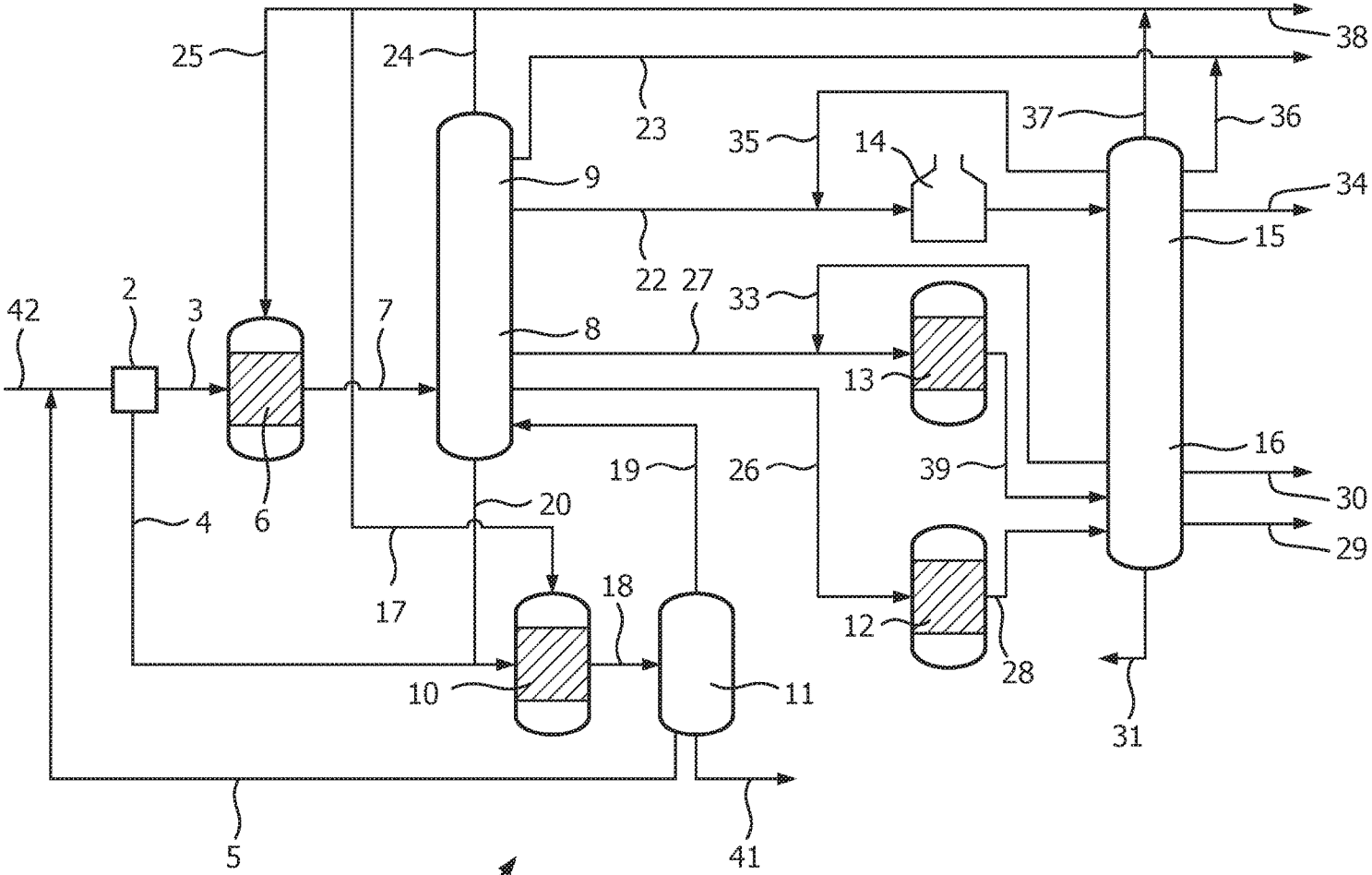
FIG. 2 is a schematic illustration of another embodiment of the process of the present invention.

Referring now to the process and apparatus schematically depicted in FIG. 2 where an integrated process 102 is shown based on a combination of hydrocracking, ethane dehydrogenation and propane/butanes dehydrogenation to convert naphtha into olefins and BTX. Feed 42, e.g. naphtha, is sent to a separation unit 2 producing a stream 4 having a high aromatic content and a stream 3 having a low aromatic content. Stream 4 is sent to hydrocracking unit 10 and its effluent 18 is separated in separation unit 11 into stream 19, mainly comprising C4− and stream 41 mainly comprising BTX. Non-converted C5+ is recycled, via line 5, to the inlet of separation unit 2, or in case that stream 5 hardly comprises BTX, to the inlet of hydrocracking unit 6. The application of a separation unit 2 is optional which means that feedstock 42 can be sent directly into hydrocracking unit 6. Effluent 7 coming from hydrocracking unit 6 is sent to separation unit 8, 9 producing a stream 27, mainly comprising C3, a stream 26, mainly comprising C4, and a stream 20 mainly comprising C5+. Stream 20 is sent to the inlet of hydrocracking unit 10. Separation unit 8, 9 provides stream 24, mainly comprising hydrogen, stream 23, mainly comprising C1, and stream 22, mainly comprising C2. Stream 22 is sent to ethane dehydrogenation unit 14 from which its effluent is separated in separation unit 15, 16 producing stream 36, mainly comprising C1, stream 37, mainly comprising hydrogen, stream 34, mainly comprising C2=, and stream 35, mainly comprising C2. Stream 35 is recycled to the inlet of ethane dehydrogenation unit 14. Hydrogen containing streams 24, 37 are sent to hydrocracking unit 6, via line 25 and hydrocracking 10, via line 17, respectively. Stream 27 is sent to a propane dehydrogenation unit 13 and its effluent 39 is sent to separation unit 15, 16. Stream 26 is sent to a butane dehydrogenation unit 12 from which its effluent 28 is sent to a separation unit 15, 16. Separation unit 15, 16 provides a stream 31, mainly comprising C5+, stream 29, mainly comprising C4 mix, stream 30, mainly comprising C3= and a recycle stream 33, mainly comprising C3, which recycle stream 33 is fed to the inlet of unit 13. The C5+ containing stream 31 can be combined with stream 5. In addition it is also possible to recycle stream 31 directly to the inlet of hydrocracking unit 6. The surplus of hydrogen is sent, via line 38, to other chemical processes.

Figure 3:
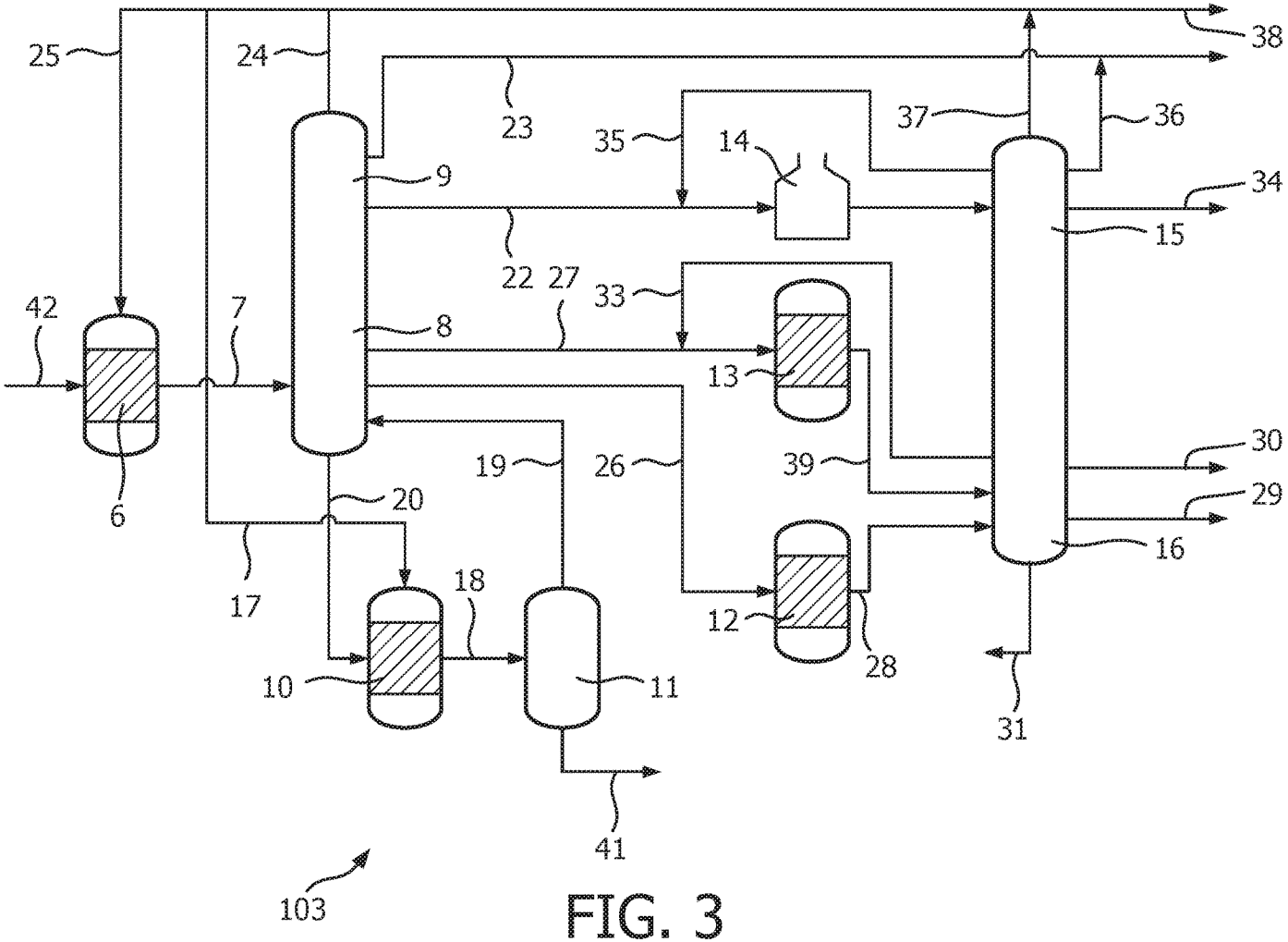
FIG. 3 is a schematic illustration of another embodiment of the process of the present invention.

FIG. 3 relates to another embodiment of an integrated process 103 based on a combination of hydrocracking, ethane dehydrogenation and propane/butanes dehydrogenation took convert naphtha into olefins and BTX.

Feedstock 42, e.g. naphtha is sent to hydrocracking unit 6 and its effluent 7 is sent to separation unit 8, 9 producing stream 27, mainly comprising C3, stream 26, mainly comprising C4 and a stream 20, mainly comprising C5+. Stream 20 is sent to hydrocracking unit 10 and its effluent 18 is separated in separation unit 11 into stream 19, mainly comprising C4−, and stream 41, mainly comprising BTX. Stream 19 is recycled to separation unit 8, 9. Stream 27 is sent to a propane dehydrogenation unit 13 from which its effluent 39 is sent to separation unit 15, 16. Stream 26 is sent to butane dehydrogenation unit 12 and its effluent 28 is sent to separation unit 15, 16, as well. Separation unit 15, 16 produces stream 30, mainly comprising C3=, stream 29, mainly comprising C4 mix and a stream 31, mainly comprising C5+. Stream 33, coming from separation unit 15, 16 and mainly comprising C3, is recycled to the inlet of unit 13. Separation unit 8, 9 provides stream 24, mainly comprising hydrogen, a stream 23, mainly comprising C1 and a stream 22, mainly comprising C2. Stream 22 is sent to the inlet of ethane dehydrogenation unit 14 from which its effluent is separated in separation unit 15, 16 into stream 37, mainly comprising hydrogen, stream 36, mainly comprising C1, stream 34, mainly comprising C2=, and recycle stream 35. Recycle stream 35, mainly comprising C2, is sent to the inlet of ethane dehydrogenation unit 14. Hydrogen containing streams 24, 37 are sent to hydrocracking unit 6, via line 25 and to hydrocracking unit 10, via line 17, respectively. Although not shown, FIG. 2 can include a separation unit 2, similar to the process 101 shown in FIG. 1. The C5+ containing stream 31 can be combined with stream 5, as shown and discussed in FIG. 1. In addition it is also possible to recycle stream 31 directly to the inlet of hydrocracking unit 6. The surplus of hydrogen is sent, via line 38, to other chemical processes.

Further improving on the process shown in FIG. 3 is that an additional reduction can be done by combining the demethanizing step from the ethane cracker separation section with the upstream gas plant/FHC effluent separation. Since the C1− fraction is by definition paraffinic this is possible without 'diluting' the olefin products. This way the most demanding/coldest separation can be done in a single location/unit in the flowchart.

Figure 4:
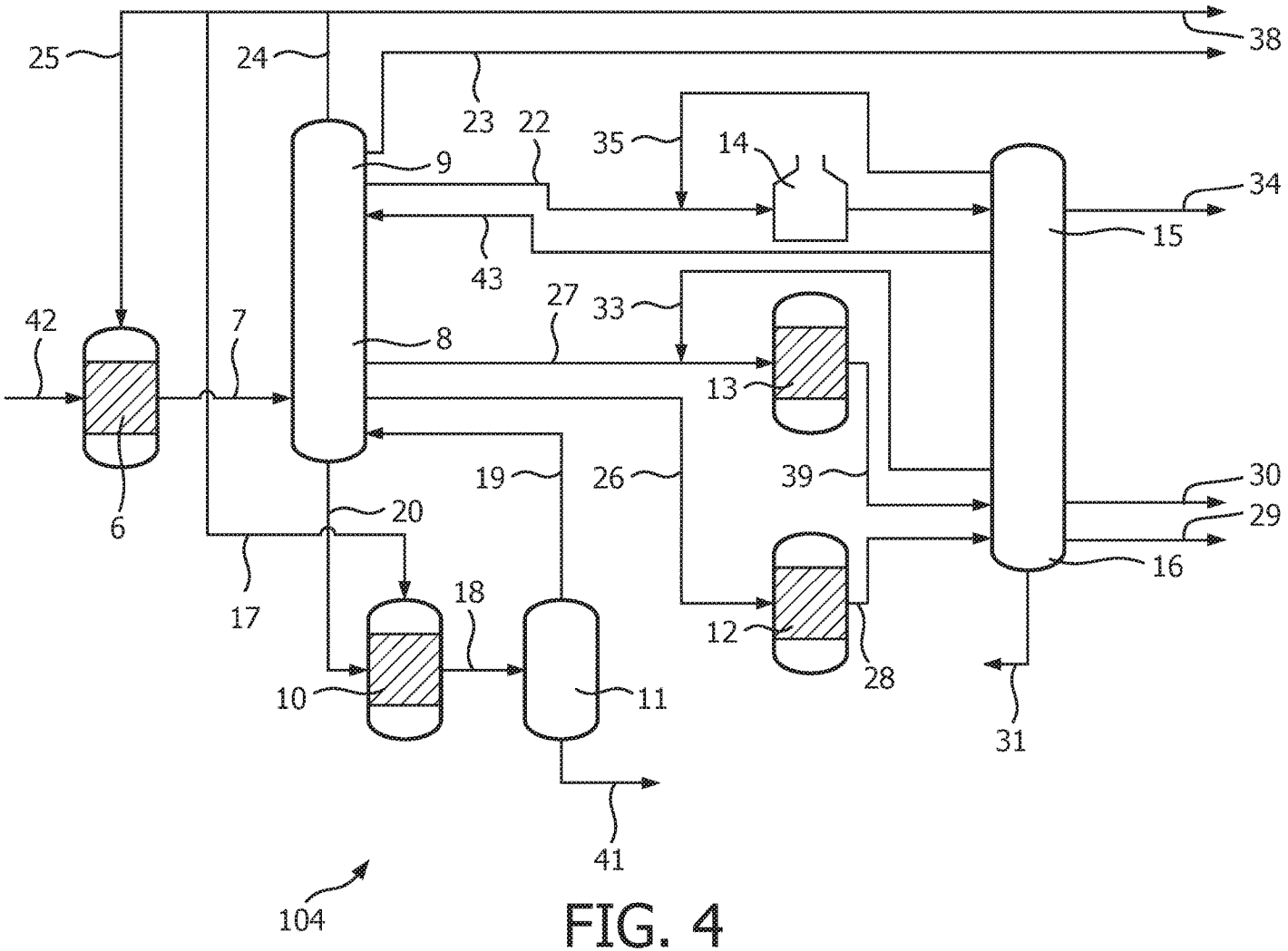
FIG. 4 is a schematic illustration of another embodiment of the process of the present invention.

FIG. 4 is another embodiment of an integrated process 104 based on a combination of hydrocracking, ethane dehydrogenation and propane/butanes dehydrogenation to convert naphtha into olefins and BTX. Feedstock 42, e.g. naphtha, is sent to hydrocracking unit 6 and its effluent 7 is sent to separation unit 8, 9. Separation unit 8, 9 provides stream 27, mainly comprising C3, stream 26, mainly comprising C4 and a stream 20, mainly comprising C5+. Stream 20 is sent to hydrocracking unit 10 from which its effluent 18 is separated in separation unit 11 into stream 41, mainly comprising BTX and stream 19, mainly comprising C4−, which stream 19 is sent to separation unit 8, 9. Separation unit 8, 9 provides stream 24, mainly comprising hydrogen, stream 23, mainly comprising C1 and stream 22, mainly comprising C2. Stream 22 is sent to the inlet of ethane dehydrogenation unit 14 from which its effluent is separated in separation unit 15, 16 into stream 34, mainly comprising C2=, stream 35, mainly comprising C2 and stream 43, mainly comprising C1−. Stream 43 is sent to separation unit 8, 9, whereas stream 35 is recycled to the inlet of ethane dehydrogenation unit 14. Stream 27 is sent to a propane dehydrogenation unit 13 from which its effluent 39 is sent to separation unit 15, 16. Stream 26 is sent to butane dehydrogenation unit 12 from which its effluent 28 is sent to separation unit 15, 16, as well. Separation unit 15, 16 provides stream 30, mainly comprising C3=, stream 29, mainly comprising C4mix, a stream 31, mainly comprising C5+ and recycle stream 33, mainly comprising C3. Stream 33 is recycled to the inlet of unit 13. Hydrogen containing stream 24 is sent to hydrocracking unit 6, via line 25, and to hydrocracking unit 10, via line 17, respectively. Non-converted C5+ coming from separation unit 11 as well as stream 31 can be recycled to the inlet of hydrocracking unit 6 (not shown here). The surplus of hydrogen is sent, via line 38, to other chemical processes. Although not shown, FIG. 4 can include a separation unit 2, similar to the process 101 shown in FIG. 1.

Figure 5:
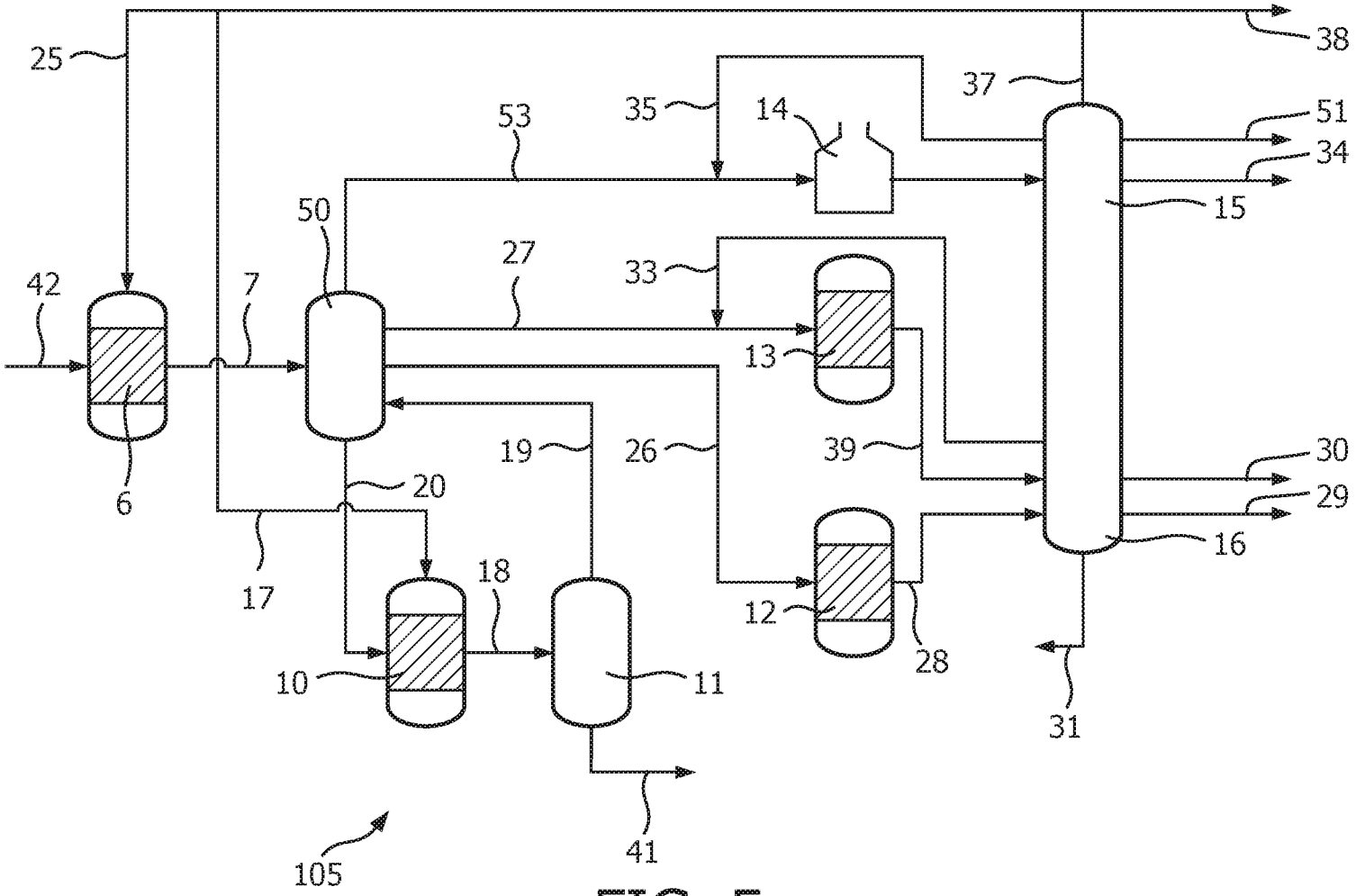
FIG. 5 is a schematic illustration of another embodiment of the process of the present invention.

FIG. 5 shows an embodiment of an integrated process 105 based on a combination of hydrocracking, ethane dehydrogenation and propane/butanes dehydrogenation to convert naphtha into olefins and BTX. Feed 42, e.g. naphtha, is sent to hydrocracking unit 6 from which its effluent 7 is sent to separation unit 50 producing stream 27, mainly comprising C3, a stream 26, mainly comprising C4 and stream 20, mainly comprising C5+. Stream 20 is sent to hydrocracking unit 10 from which its effluent 18 is separated in separation unit 11 into stream 19, mainly comprising C4− and stream 41, mainly comprising BTX. Stream 19 can be recycled to separation unit 50. Stream 53, mainly comprising C2−, coming from separation unit 50 is sent to ethane dehydrogenation unit 14 from which its effluent is separated in separation unit 15, 16 into stream 37, mainly comprising hydrogen, stream 51, mainly comprising C1, stream 34, mainly comprising C2= and recycle stream 35, mainly comprising C2. Recycle stream 35 is sent to the inlet of ethane dehydrogenation unit 14. Stream 27, coming from separation unit 50, is sent to a propane dehydrogenation unit 13 from which its effluent 39 is separated in separation unit 15, 16. Stream 26, mainly comprising C4, coming from separation unit 50 is sent to a butane dehydrogenation unit 12 from which its effluent 28 is sent to separation unit 15, 16. Separation unit 15, 16 provides a stream 30, mainly comprising C3=, a stream 29, mainly comprising C4mix, a stream 31, mainly comprising C5+ and a recycle stream 33, mainly comprising C3. Stream 33 is recycled to the inlet of unit 13. Hydrogen containing stream 37 is sent to hydrocracking unit 6, via line 25, and to hydrocracking unit 10, via line 17, respectively. The surplus of hydrogen is sent, via line 38, to other chemical processes. Stream 31 coming from separation unit 15, 16 as well as non-converted C5+ coming from separation unit 11 can be sent to the inlet of hydrocracking unit 6 (not shown here). The pre-treatment step as disclosed in FIG. 1, especially separation unit 2, can also be present in process 105.

As mentioned above, the dehydrogenation unit 12 is depicted as a butane dehydrogenation unit but can be a combined propane/butanes dehydrogenation unit (PDH-BDH) as well. The same applies for the propane dehydrogenation unit 13 which unit can be a combined propane/butanes dehydrogenation unit (PDH-BDH) as well.

The invention claimed is:

1. A process for converting a hydrocarbon feedstock into olefins and BTX, said converting process comprising the steps of:

feeding a hydrocarbon feedstock to a first hydrocracking unit to produce an effluent from said first hydrocracking unit;

feeding said effluent from said first hydrocracking unit to a first separation section;

separating said effluent from said first hydrocracking unit in said first separation section into one or more streams selected from the group consisting of a stream comprising hydrogen, a stream comprising methane, a stream comprising ethane, a stream comprising propane, a stream comprising butanes, a stream comprising C1-minus, a stream comprising C3-minus, a stream comprising C4-minus, a stream comprising C1-C2, a stream comprising C1-C3, a stream comprising C1-C4, a stream comprising C2-C3, a stream comprising C2-C4, a stream comprising C3-C4 and a stream comprising C5+;

feeding said stream comprising propane to at least one dehydrogenation unit selected from the group consisting of a combined propane/butanes dehydrogenation unit and a propane dehydrogenation unit; and feeding said stream comprising C1-C2 to a gas steam cracking unit and/or to a second separation unit and feeding at least one of effluents from said dehydrogenation unit and said gas steam cracking unit to second separation section;

feeding said stream comprising ethane to an ethane dehydrogenation unit to produce an effluent; and feeding the effluent from said ethane dehydrogenation unit to said second separation unit.

2. The process according to claim 1, further comprising feeding said stream comprising butanes to at least one dehydrogenation unit from the group including the combined propane/butanes dehydrogenation unit and a butanes dehydrogenation unit.

3. The process according to claim 1, wherein said dehydrogenating process is a catalytic process and said steam cracking process is a thermal cracking process.

4. The process according to claim 1, further comprising feeding said stream comprising C5+ to a second hydrocracking unit.

5. The process according to claim 4, further comprising separating effluent from said second hydrocracking unit into a stream comprising C4– minus, a stream comprising unconverted C5+, and a stream comprising BTX.

6. The process according to claim 5, further comprising feeding said stream comprising C4-minus originating from said second hydrocracking unit to said first separation section.

7. The process according to claim 5, further comprising combining said stream comprising unconverted C5+ originating from said second hydrocracking unit with said hydrocarbon feedstock and feeding the combined stream thus obtained to said first hydrocracking unit.

8. The process according to claim 4, further comprising pretreating said hydrocarbon feedstock by separating said hydrocarbon feedstock into a stream having a high aromatics content and a stream having a low aromatics content, and feeding said stream having a low aromatics content into said first hydrocracking unit and further comprising feeding said stream having a high aromatics content to said second hydrocracking unit.

9. The process according to claim 3, further comprising feeding said stream comprising butanes to at least one dehydrogenation unit from the group including the combined propane/butanes dehydrogenation unit and a butanes dehydrogenation unit.

10. The process according to claim 1, further comprising separating any effluent from said ethane dehydrogenation unit, said first separation section, said butanes dehydrogenation unit, said combined propane-butanes dehydrogenation unit and said propane dehydrogenation unit in said second separation section into one or more form the group including a stream comprising hydrogen, a stream comprising methane, a stream comprising C3, a stream comprising C4mix, a stream comprising C5+, a stream comprising C2 and a stream comprising C1-minus.

11. The process according to claim 10, further comprising feeding said stream comprising C5+ originating from said second separation section to said first hydrocracking unit and/or said second hydrocracking unit.

12. The process according to claim 10, further comprising feeding said stream comprising hydrogen originating from said second separation section to said first hydrocracking unit and/or said second hydrocracking unit.

13. The process according to claim 10, further comprising feeding said stream comprising C1-minus originating from said second separation section to said first separation section.

14. The process according to claim 10, further comprising feeding said stream comprising C3 originating from said second separation section to said propane dehydrogenation unit and/or said combined propane/butanes dehydrogenation unit.

15. A process for converting a hydrocarbon feedstock into olefins and BTX, said converting process comprising the steps of:

feeding a hydrocarbon feedstock to a first hydrocracking unit;

feeding effluent from said first hydrocracking unit to a first separation section;

separating said effluent in said first separation section into a stream comprising methane, a stream comprising ethane, a stream comprising propane and a stream comprising butanes;

feeding said stream comprising propane to at least one dehydrogenation unit from the group including a combined propane/butanes dehydrogenation unit and a propane dehydrogenation unit;

feeding at least one of effluents from said at least one dehydrogenation unit to a second separation section;

feeding said stream comprising ethane to an ethane dehydrogenation unit to produce an effluent from said ethane dehydrogenation unit; and feeding the effluent from said ethane dehydrogenation unit to a gas steam cracker.

16. A process for converting a hydrocarbon feedstock into olefins and BTX, said converting process comprising the steps of:

feeding a hydrocarbon feedstock to a first hydrocracking unit;

feeding effluent from said first hydrocracking unit to a first separation section;

separating said effluent in said first separation section into a stream comprising ethane, a stream comprising propane, a stream comprising butanes, a stream comprising $C_1$-$C_2$ hydrocarbons; and a stream comprising $C_2$ hydrocarbons;

feeding said stream comprising propane to at least one dehydrogenation unit from the group including a combined propane/butanes dehydrogenation unit and a propane dehydrogenation unit to produce an effluent from said at least one dehydrogenation unit;

feeding at least one stream selected from the group consisting of said stream comprising ethane, and said stream comprising C1-C2 hydrocarbons to a gas steam cracking unit to produce an effluent therefrom; and feeding said effluent from said at least one dehydrogenation unit and said gas steam cracking unit to second separation section.

17. The process according to claim 1, further comprising feeding said stream comprising butanes to at least one dehydrogenation unit from the group including the combined propane/butanes dehydrogenation unit (PDH-BDH) and a butanes dehydrogenation unit, (BDH).

18. The process according to claim 15, wherein said steam cracking unit is a thermal cracking unit.

19. The process according to claim 16, wherein said steam cracking unit is a thermal cracking unit.

* * * * *